US006581988B1

(12) United States Patent
Mihail

(10) Patent No.: US 6,581,988 B1
(45) Date of Patent: Jun. 24, 2003

(54) TWO STAGE CRUSH ZONE LATCH

(75) Inventor: Adrian Mihail, Richmond Hill (CA)

(73) Assignee: Atoma International, Corp., Newmarket (CA)

( * ) Notice: Subject to any disclaimer, the term of this patent is extended or adjusted under 35 U.S.C. 154(b) by 0 days.

(21) Appl. No.: 09/980,600

(22) PCT Filed: May 11, 2000

(86) PCT No.: PCT/CA00/00551

§ 371 (c)(1),
(2), (4) Date: Oct. 31, 2001

(87) PCT Pub. No.: WO00/68537

PCT Pub. Date: Nov. 16, 2000

Related U.S. Application Data

(60) Provisional application No. 60/133,596, filed on May 11, 1999.

(51) Int. Cl.[7] ..... E05C 3/06

(52) U.S. Cl. ..... 292/216; 292/DIG. 65

(58) Field of Search ..... 292/216, 201, 292/DIG. 65, DIG. 23; 70/264

(56) References Cited

U.S. PATENT DOCUMENTS 3,331,624 A * 7/1967 Pugh ..... 292/216
4,172,768 A 10/1979 Cerdan
4,875,724 A 10/1989 Gruber
4,995,654 A 2/1991 Nishigami et al.
5,046,769 A 9/1991 Rimbey et al.
5,074,603 A 12/1991 Brackmann
5,308,130 A 5/1994 Lee
5,382,062 A 1/1995 Kostler
5,860,683 A * 1/1999 Sekino ..... 292/216
5,865,481 A 2/1999 Buschmann
5,896,767 A * 4/1999 Gomi ..... 70/237
6,010,164 A * 1/2000 Yoda ..... 292/216

* cited by examiner

*Primary Examiner*—Gary Estremsky
(74) *Attorney, Agent, or Firm*—Clark Hill PLC

(57) ABSTRACT

A latch (10) having a housing (12, 14, 16, 18) to which a ratchet (38) is pivotably mounted by a rivet (40) for rotation about a first axis between a latched and unlatched configuration. A slot (44) extents through the latch and has a first arcuate portion (100) and a first radial portion (102). A pawl assembly (48, 58, 60, 70) has a roller (48) extending through the slot (44). The pawl assembly is mounted to the housing for movement of the roller relative to the ratchet (38) between a first arcuate portion and a first radial portion of the slot. The rivet (40) is deformable to allow the ratchet (38) to rotate about the roller axis upon the ratchet (38) being exposed to an unlatching force above a predetermined level. A flange (108) extends from the housing across the ratchet (38) to limit the pivotal movement of the ratchet (38) about the roller axis.

10 Claims, 2 Drawing Sheets

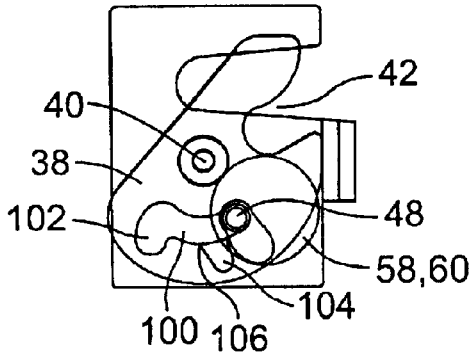
FIG.2
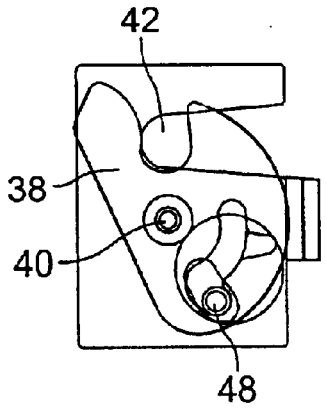
FIG.3
FIG.4
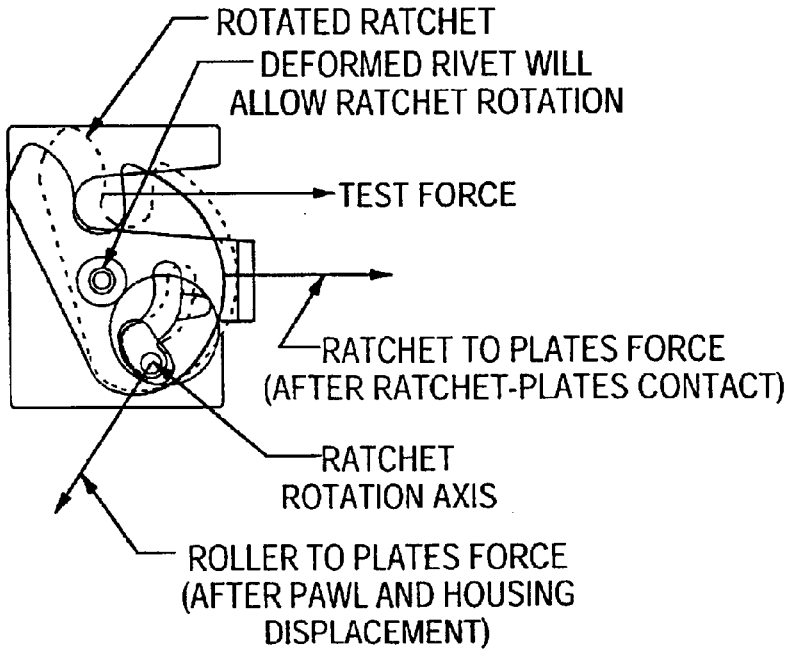

TWO STAGE CRUSH ZONE LATCH

This application claims the benefit of Provisional application Ser. No. 60/133,596, filed May 11, 1999.

FIELD OF THE INVENTION

The present invention relates to vehicle door latches. In particular, this invention relates to a vehicle door latch having a two stage crush zone.

BACKGROUND OF INVENTION

Vehicle door latches must meet specified safety standards. In the United States of America, the latch must meet Federal Motor Vehicle Safety Standard (FMVSS) 206 which requires that the latch and striker assembly shall not separate when a high force is applied. For testing, the latches are loaded to resist loads in the range of 8,900 to 10,700 N, which results in reaction forces for the ratchet and the pawl pins of between 20,000 and 30,000 N. However, in normal use conditions, the latch experiences loads in the range of 100 to 300 N which corresponds to a seal force. As a result, conventional latches arc over-designed in size and cost.

SUMMARY OF THE INVENTION

The disadvantages of the prior art may be overcome by providing a latch which will meet all of the design criteria, but will have a predictable and controlled deformation during high load conditions to modify force directions and locations to the strongest portions of the latch and thereby resist separation.

More particularly, a latch is provided which has a housing and a ratchet pivotably mounted to the housing by a rivet for rotation about a first axis between a latched and an unlatched configuration. The housing has a slot extending through it with an arcuate portion generally coaxial with the first axis and a first radial portion extending generally radially away from the first axis. The latch further has a pawl assembly with a roller extending through the slot and mounted to the housing for movement of the roller relative to the ratchet between the first arcuate portion and the first radial portion of the slot. The roller has a roller axis. The rivet is deformable to allow the ratchet to rotate about the roller axis upon the ratchet being exposed to an unlatching force above a predetermined level. A flange extends from the housing across the ratchet to limit pivotal movement of the ratchet about the roller axis.

The roller may be mounted to the housing by a pair of wheels, one on either side of the ratchet, and rotatable relative to the housing about a second axis generally parallel to the first axis.

The latch may include a ratchet spring acting between the ratchet and the housing for urging the ratchet toward the unlatched configuration.

The latch may also have a pawl spring extending between the housing and at least one of the wheels for urging the roller toward the arcuate portion of the slot.

The latch may include an actuator having a Bowden cable with an outer portion fixedly secured to the housing and an inner connected to the pair of the wheels for rotating the pair of wheels to move the roller into the arcuate portion of the slot.

The ratchet may have a second radial portion spaced apart from the first radial portion and extending generally radially from the first axis the the roller may engage the second radial portion to retain the ratchet in the unlatched configuration.

The second radial portion may further have a tapered comer along one side thereof to guide the roller into the arcuate portion of the latch in response to a force tending to move the ratchet from its unlatched towards its unlatched configuration.

The latch housing may include a front housing, a rear housing generally parallel to and spaced apart from the front housing, a front mounting plate adjacent the first housing and a rear mounting plate adjacent the rear housing. The ratchet may be mounted between the front and rear mounting plates and each wheel of the pair of wheels may be rotatably mounted to a respective of the front and rear housings.

The flange may be defined by at least one of the front and rear mounting plates.

The ratchet spring may be mounted between the front housing and front mounting plate and the front housing provided with a recess for accommodating the ratchet spring. The pawl spring may be mounted between the rear housing and the rear mounting plate provided with a recess for accommodating the pawl spring.

The rivet may extend between and be secured to the front and rear housings.

BRIEF DESCRIPTION OF THE DRAWINGS

In drawings which illustrate embodiments of the invention,

FIG. 2 is a front elevational view of the latch of FIG. 1 in the open or unlatched position, with cover removed;

FIG. 3 is a front elevational view of the latch of FIG. 1 in the closed or latched position, with cover removed; and FIG. 4 is a front elevational view of the latch of FIG. 1 under high load test conditions.

DESCRIPTION OF THE PREFERRED EMBODIMENT

Figure 1:
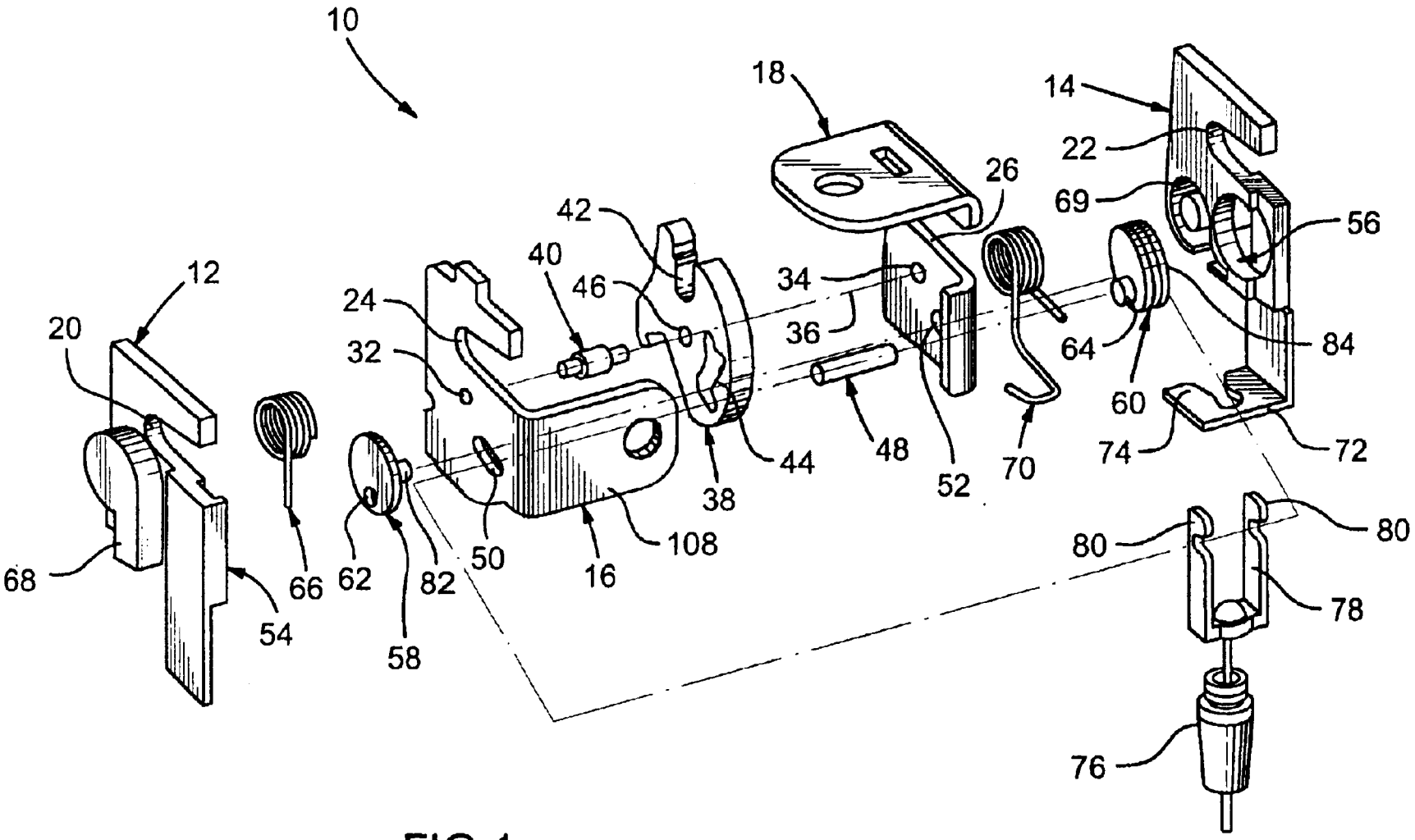
FIG. 1 is an exploded perspective view of a latch of the present invention.

Referring to FIG. 1, there is shown a latch 10 of the present invention. The latch 10 comprises a housing including front housing 12, rear housing 14, front mounting plate 16 and rear mounting plate 18. Each of the housings 12 and 14, and the plates 16 and 18 has a U-shaped mouth 20, 22, 24 and 26, respectively, which when assembled, a align to present a mouth which receives a striker (not illustrated). Each mounting plate 16 and 18 has a central bore 32 and 34, respectively, defining a first axis of rotation 36.

Ratchet 38 is positioned between mounting plates 16, 18 and is pivotally mounted on a rivet 40 through central bore 46. The rivet 40 extends through bores 32, 34 of mounting plates 16, 18. Ratchet 38 has a U-shaped mouth 42. Mouth 42 of ratchet 38 cooperates with the mouth of the housing as the ratchet 38 rotates to secure a striker in a latched condition.

The ratchet 38 also has a slot 44. Referring to FIGS. 2 and 3, the slot 44 has an arcuate portion 100, a first radial portion 102, and a second radial portion 104. Arcuate portion 100 extends circumferentially relative to the central bore 46. First radial portion 102 is spaced circumferentially relative to the second radial portion 104. The slot 44 receives roller 48 of the pawl assembly.

Referring back to FIG. 1, the pawl assembly generally comprises roller 48, wheels 58 and 60 and pawl spring 70.

Mounting plates 16 and 18 each has an arcuate slot 50 and 52, respectively, which align with the radial portions 102 and 104 of slot 44 when the latch 10 is assembled. Roller 48 extends through arcuate slots 50 and 52 and is slidable therein. In normal use conditions, roller 48 is floating between the ratchet 38 and the arcuate slots 50 and 52.

Front housing 12 and rear housing 14 each has a circular recess 54, 56, respectively, which receives wheels 58 and 60. Wheels 58 and 60 are mounted to rotate about a second axis spaced from the first axis of rotation 36. Each of wheels 58 and 60 has an axially extending pin 62, 64 which engage opposite ends of the roller 48. As is now apparent, rotation of the wheels 58 and 60 moves the roller 48 in the slot 44 radially inwardly and outwardly between unlatching and latching positions. When roller 48 is radially inwardly, ratchet 38 is free to rotate. When the roller 48 is radially outwardly in either the radial portions 102 or 104, the ratchet 38 is prevented from rotating at least in the unlatching sense. When the roller 48 is radially outward in radial portion 102, the latch 10 is in the latched condition. When the roller 48 is radially outward in radial portion 104 or radially inward in the distal end of arcuate portion. 100, the latch 10 is in the unlatched condition.

Ratchet spring 66 extends between front housing 12 and the ratchet 38 to bias the ratchet 38 in an open or unlatched condition. Preferably, front housing 12 has a recess 68 sized to receive ratchet spring 66.

Pawl spring 70 extends between rear housing 14 and wheel 60 to bias the pawl assembly into a latching condition, i.e. urging roller 48 to the radially outward position or latching position. Preferably, rear housing 14 has a recess 69 sized to receive spring 70.

Rear housing 14 has a flange 72 which is spaced from the pawl assembly. Flange 72 has a U-shaped opening 74 which receives Bowden wire 76. Bowden wire 76 is fitted with a U-shaped hooking member 78. The hooking member 78 has a pair of hooks 80 which engage the pins 82, 84. Actuation of the Bowden wire 76 rotates the pawl assembly against the bias of the pawl spring 70 to move roller 48 from the radially outward position or latching position to the radially inward position or unlatching position. Upon relaxation of the Bowden wire 76, the bias of pawl spring 70 returns the pawl assembly back to the latching position Referring to FIGS. 2 and 3, the operation of the latch 10 of the present invention will be described. The arcuate length of arcuate portion 100 limits the travel of the ratchet 38 between the fully open or unlatched position (FIG. 2) and the closed or latched position (FIG. 3). As the ratchet 38 rotates, the mouth 42 of the ratchet 38 cooperates with housing mouth to latch a striker.

In the open position, roller 48 will be in the distal end of arcuate portion 100. Roller 48 will be rotated inwardly against the bias of pawl spring 70. As the ratchet 38 is rotated in a closing sense in response to engagement with a striker, the ratchet 38 will rotate initially until the roller 48 is able to enter radial portion 104. The bias of pawl spring 70 will urge the roller 48 outwardly allowing the roller 48 to move outwardly along radial portion 104. In this position, the latch 10 will be in the secondary closed condition. Radial portion 104 has a tapered comer 106 which biases the ratchet 38 to move in a closing or latching sense yet prevents rotation in the opening or unlatching sense.

Further rotation of the ratchet 38 in the closing or latching sense, will urge the roller to travel relatively along the arcuate portion 100 until the roller 48 is able to travel outwardly along radial portion 102. Once roller 48 is in the outward or latching position, ratchet 38 is releasably secured in the latched position.

In the latched position, the ratchet 38 is supported at both the pin 40 and the roller 48. The pin 40 and the roller 48 cooperate to resist an opening force. To release, the Bowden wire 76 is pulled which responsive rotates wheels 58, 60 which in turn moves roller 48 radially inwardly to the unlatching position. The bias of ratchet spring 66 rotates the ratchet 38 in the unlatching sense releasing the striker.

In order to test the latch according the FMVSS Standards, a test force in the range of 8,900 to 10,700 N is applied to the ratchet 38 at the mouth 42. The ratchet 38 will be urged in the unlatching sense. The roller 48 will engage the plates 16, 18 and resist further movement of the ratchet in the unlatching sense. At this point, further forces will plastically deform pin 40 allowing the ratchet 38 to rotate about the axis of the roller 48. The ratchet 38 will rotate until it contacts the front flange 108 of plate 18. Once the ratchet 38 contacts the front flange 108, the forces transmitted through the pin 40 will reduce significantly without breakage. The majority of the test forces will be transmitted through the front flange 108 and the plates 16, 18, through roller 48 and thereby resist opening even under the test forces.

As is now apparent to those skilled in the art, the pin 40 is designed to plastically deform at forces above the normal use conditions, about 300 N but well below the test loads of 8,900 to 10,700 N. The pin 40 is designed to deform well before the roller 48 deforms. However, if the pin were to break, such failure would not affect the latch response to the higher loads.

Although the invention has been described with reference to certain specific embodiments, various modifications thereof will be apparent to those skilled in the art without departing from the scope of the invention.

I claim:

1. A latch comprising:

a housing;

a ratchet pivotably mounted to said housing by a rivet for rotation about a first axis between a latched and unlatched configuration;

said ratchet having a slot extending therethrough with an arcuate portion generally concentric with said first axis and a first radial portion extending generally radially from said first axis;

a pawl assembly having a roller extending through said slot and mounted to said housing for movement relative to said ratchet between said first arcuate portion and said first radial portion, said roller having a roller axis, said pawl assembly operatively coupled between said housing and said ratchet for moving said roller from said arcuate portion of said slot with said ratchet in said unlatched configuration to said first radial portion of said slot with said ratchet in said latched configuration; and a flange extending from said housing across said ratchet to limit pivotal movement of said ratchet about said roller axis; whereby said rivet is deformable to force said ratchet to rotate about said roller axis when said roller is seated in said first radial portion and said ratchet is in said latched configuration upon said ratchet being exposed to an unlatching force above a predetermined threshold value.

2. A latch as claimed in claim 1 wherein said roller is mounted to said housing by a pair of wheels rotatable relative to said housing about a second axis generally parallel to said first axis, said ratchet extending between said pair of wheels.

3. A latch as claimed in claim 2 further having a ratchet spring acting between said ratchet and said housing for urging said ratchet toward said unlatched configuration.

4. A latch as claimed in claim 3 further having a pawl spring extending between said housing and at least one of said wheels for urging said roller toward said arcuate portion of said slot.

5. A latch as claimed in claim 4 further having an actuator having a Bowden cable with an outer portion fixedly secured to said housing and an inner portion connected to said pair of wheels for rotating said pair of wheels to move said roller into said arcuate portion of said slot.

6. A latch as claimed in claim 1 wherein said ratchet has a second radial portion spaced apart from said first radial portion and extending generally radially from said first axis; said roller engages said second radial portion to retain said ratchet in said unlatched configuration; said second radial portion has a tapered corner along one side thereof to guide said roller into said arcuate portion of said latch in response to a force tending to move said ratchet from said unlatched configuration toward said latched configuration.

7. A latch as claimed in claim 6 wherein said housing includes a front housing, a rear housing generally parallel to and spaced apart from said first housing;

a front mounting plate adjacent said front housing;

a rear mounting plate adjacent said rear housing;

said ratchet is mounted between said front and rear mounting plates; and each wheel of said pair of wheels is rotatably mounted to a respective of said front and rear housings.

8. A latch as claimed in claim 7 wherein said flange is defined by at least one of said front and rear mounting plates.

9. A latch as claimed in claim 8 wherein:

said ratchet spring is mounted between said front housing and said front mounting plate;

said front housing has a recess for accommodating said ratchet spring;

said pawl spring is mounted between said rear housing and said rear mounting plate;

said rear housing has a recess for accommodating said pawl spring.

10. A latch as claimed in claim 9 wherein said rivet extends between and is secured to said front and rear housings.

* * * * *